US006078029A

United States Patent [19]

Trujillo et al.

[11] Patent Number: 6,078,029

[45] Date of Patent: Jun. 20, 2000

[54] EFFICIENT COOKING RANGE SYSTEM

[76] Inventors: Jorge M. Trujillo; Luzmaria J. Trujillo, both of 6319 Red Cedar Pl., Baltimore, Md. 21209

[21] Appl. No.: 09/168,482

[22] Filed: Oct. 8, 1998

[51] Int. Cl.[7] ..... F27D 11/00

[52] U.S. Cl. ..... 219/415; 219/454; 219/418; 219/386; 219/430; 126/211; 126/214 R

[58] Field of Search ..... 219/417, 419, 219/415, 386, 430, 432, 438, 439, 454; 126/214 R, 211, 39 R, 39 B

[56] References Cited

U.S. PATENT DOCUMENTS 4,284,880 8/1981 Keiser ..... 219/415
4,798,939 1/1989 Nett ..... 219/438
4,869,231 9/1989 Rice et al. ..... 126/214 R
5,910,265 6/1999 Baker et al. ..... 219/454

*Primary Examiner*—Tu Ba Hoang
*Assistant Examiner*—Leonid Fastovsky

[57] ABSTRACT

An efficient cooking range system for maximizing the contact between the heating element of a cooking range and a cooking pot or pan being heated by the heating element. The efficient cooking range system includes a cooking range with a cook top having a cooking well therein. The cooking well has an interior base wall and an interior perimeter side wall upwardly extending around the interior base wall of the cooking well. An insulating layer is provided on the interior base wall and the interior perimeter side wall of the cooking well. A drop basin is provided in the cooking well. The drop basin has a bottom wall and a side wall upwardly extending around the bottom wall. A coiled heating element is provided in the cooking well beneath the bottom wall of the drop basin.

12 Claims, 3 Drawing Sheets

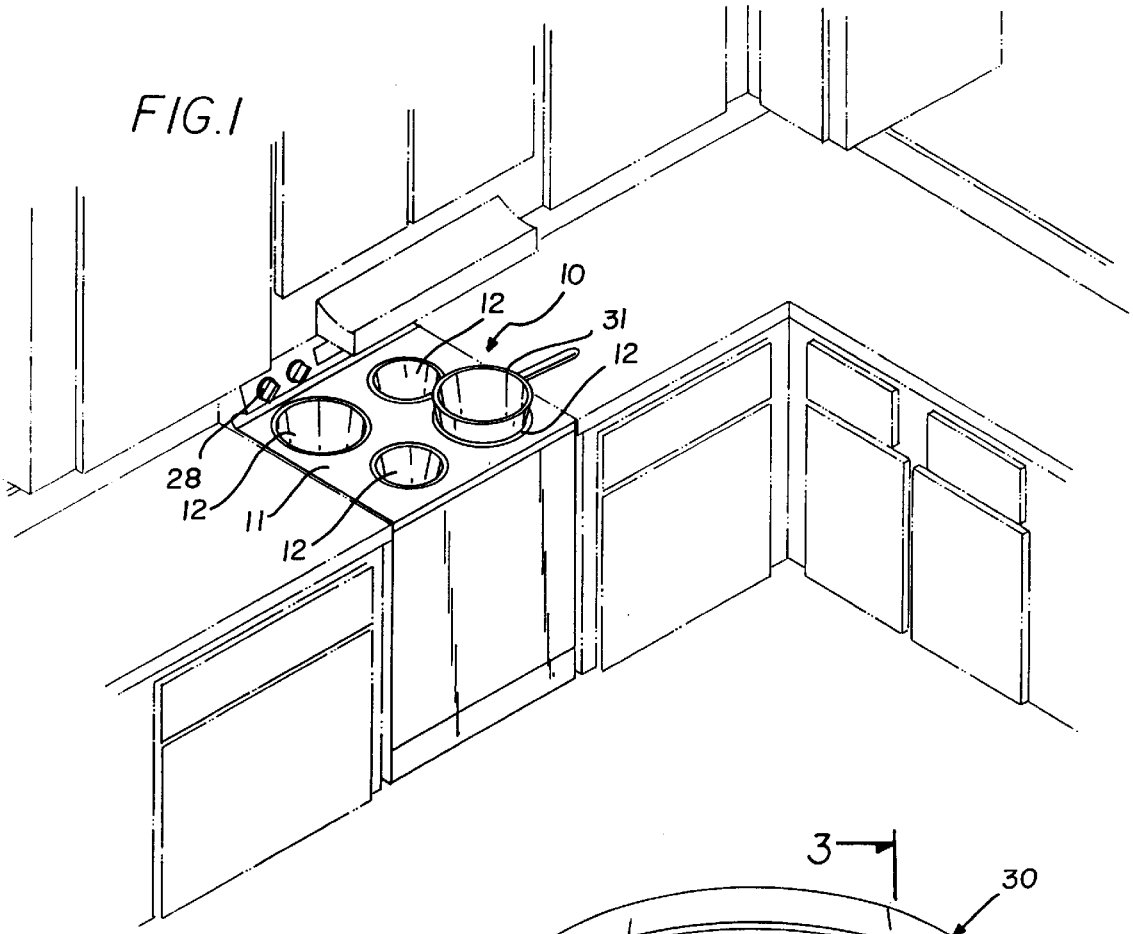
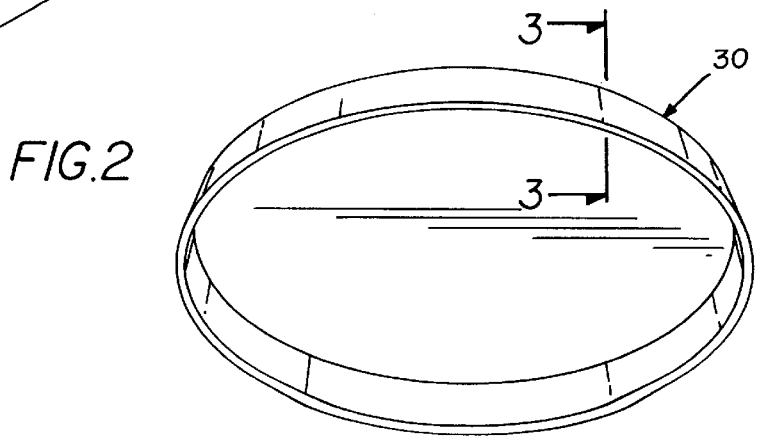
FIG.2
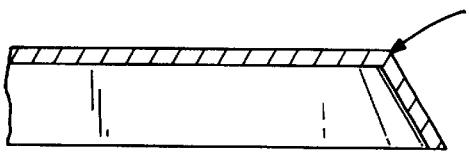
FIG.3

EFFICIENT COOKING RANGE SYSTEM

BACKGROUND OF THE INVENTION

1. Field of the Invention

The present invention relates to cooking ranges and more particularly pertains to a new efficient cooking range system for maximizing the contact between the heating element of a cooking range and a cooking pot or pan being heated by the heating element.

2. Description of the Prior Art

The use of cooking ranges is known in the prior art. More specifically, cooking ranges heretofore devised and utilized are known to consist basically of familiar, expected and obvious structural configurations, notwithstanding the myriad of designs encompassed by the crowded prior art which have been developed for the fulfillment of countless objectives and requirements.

Known prior art cooking ranges include U.S. Pat. No. 5,226,409; U.S. Pat. No. 5,044,352; U.S. Pat. No. 5,125,393; U.S. Pat. No. 4,154,218; U.S. Pat. No. Des. 357,610; and U.S. Pat. No. Des. 248,208.

While these devices fulfill their respective, particular objectives and requirements, the aforementioned patents do not disclose a new efficient cooking range system. The inventive device includes a cooking range with a cook top having a cooking well therein. The cooking well has an interior base wall and an interior perimeter side wall upwardly extending around the interior base wall of the cooking well. An insulating layer is provided on the interior base wall and the interior perimeter side wall of the cooking well. A drop basin is provided in the cooking well. The drop basin has a bottom wall and a side wall upwardly extending around the bottom wall. A coiled heating element is provided in the cooking well beneath the bottom wall of the drop basin.

In these respects, the efficient cooking range system according to the present invention substantially departs from the conventional concepts and designs of the prior art, and in so doing provides an apparatus primarily developed for the purpose of maximizing the contact between the heating element of a cooking range and a cooking pot or pan being heated by the heating element.

SUMMARY OF THE INVENTION

In view of the foregoing disadvantages inherent in the known types of cooking ranges now present in the prior art, the present invention provides a new efficient cooking range system construction wherein the same can be utilized for maximizing the contact between the heating element of a cooking range and a cooking pot or pan being heated by the heating element.

The general purpose of the present invention, which will be described subsequently in greater detail, is to provide a new efficient cooking range system apparatus and method which has many of the advantages of the cooking ranges mentioned heretofore and many novel features that result in a new efficient cooking range system which is not anticipated, rendered obvious, suggested, or even implied by any of the prior art cooking ranges, either alone or in any combination thereof.

To attain this, the present invention generally comprises a cooking range with a cook top having a cooking well therein. The cooking well has an interior base wall and an interior perimeter side wall upwardly extending around the interior base wall of the cooking well. An insulating layer is provided on the interior base wall and the interior perimeter side wall of the cooking well. A drop basin is provided in the cooking well. The drop basin has a bottom wall and a side wall upwardly extending around the bottom wall. A coiled heating element is provided in the cooking well beneath the bottom wall of the drop basin.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new efficient cooking range system apparatus and method which has many of the advantages of the cooking ranges mentioned heretofore and many novel features that result in a new efficient cooking range system which is not anticipated, rendered obvious, suggested, or even implied by any of the prior art cooking ranges, either alone or in any combination thereof.

It is another object of the present invention to provide a new efficient cooking range system which may be easily and efficiently manufactured and marketed.

It is a further object of the present invention to provide a new efficient cooking range system which is of a durable and reliable construction.

An even further object of the present invention is to provide a new efficient cooking range system which is susceptible of a low cost of manufacture with regard to both materials and labor, and which accordingly is then susceptible of low prices of sale to the consuming public, thereby making such efficient cooking range system economically available to the buying public.

Still yet another object of the present invention is to provide a new efficient cooking range system which provides in the apparatuses and methods of the prior art some of the advantages thereof, while simultaneously overcoming some of the disadvantages normally associated therewith.

Still another object of the present invention is to provide a new efficient cooking range system for maximizing the contact between the heating element of a cooking range and a cooking pot or pan being heated by the heating element.

Yet another object of the present invention is to provide a new efficient cooking range system which includes a cooking range with a cook top having a cooking well therein. The cooking well has an interior base wall and an interior perimeter side wall upwardly extending around the interior base wall of the cooking well. An insulating layer is provided on the interior base wall and the interior perimeter side wall of the cooking well. A drop basin is provided in the cooking well. The drop basin has a bottom wall and a side wall upwardly extending around the bottom wall. A coiled heating element is provided in the cooking well beneath the bottom wall of the drop basin.

Still yet another object of the present invention is to provide a new efficient cooking range system that minimizes heat dispersion and shortens cooking time on a cooking range.

Even still another object of the present invention is to provide a new efficient cooking range system that helps prevent accidental knocking over of pots and pans on the cooking range.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic perspective view of a new efficient cooking range system according to the present invention.

FIG. 2 is a schematic bottom perspective view of a lid a cooking well of the present invention.

FIG. 3 is a schematic cross sectional view of the lid of FIG. 2 taken from line 3—3 of FIG. 2.

DESCRIPTION OF THE PREFERRED EMBODIMENT

Figure 4:
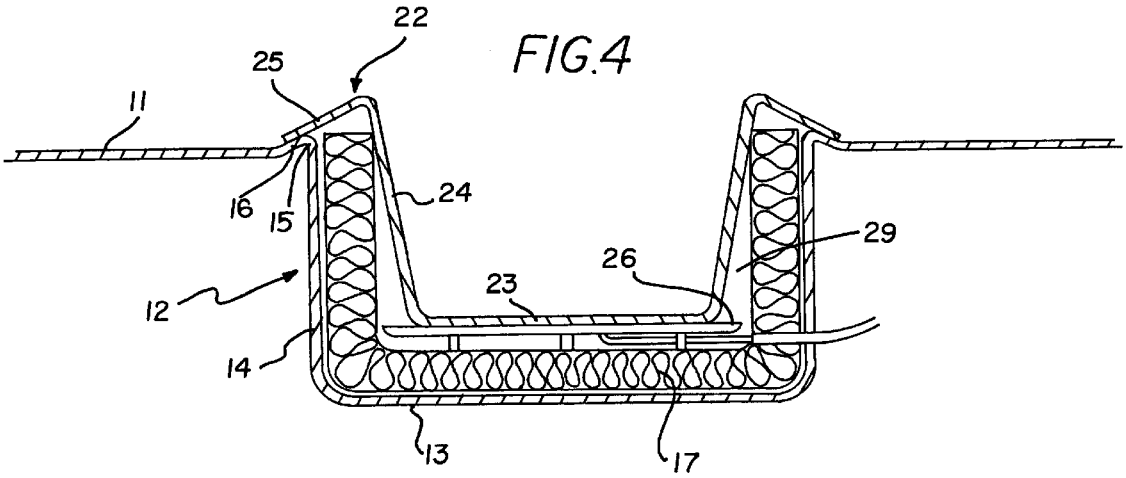
FIG. 4 is a schematic cross sectional view of an embodiment of the cooking well of the present invention.

With reference now to the drawings, and in particular to FIGS. 1 through 6 thereof, a new efficient cooking range system embodying the principles and concepts of the present invention and generally designated by the reference numeral 10 will be described.

As best illustrated in FIGS. 1 through 6, the efficient cooking range system 10 generally comprises a cooking range 10 with a cook top 11 having a cooking well 12 therein. The cooking well 12 has an interior base wall 13 and an interior perimeter side wall 14 upwardly extending around the interior base wall 13 of the cooking well 12. An insulating layer 17 is provided on the interior base wall 13 and the interior perimeter side wall 14 of the cooking well 12. A drop basin 22 is provided in the cooking well 12. The drop basin 22 has a bottom wall 23 and a side wall 24 upwardly extending around the bottom wall 23. A coiled heating element 26 is provided in the cooking well 12 beneath the bottom wall 23 of the drop basin 22.

In closer detail, the cooking range 10 has a generally flat cook top 11 with at least one cooking well 12 therein. The well is preferably generally cylindrical and has a generally cylindrical interior base wall 13 and an interior perimeter side wall 14 upwardly extending around the interior base wall 13 of the cooking well 12. The cook top 11 preferably has an annular raised edge around the interior perimeter side wall 14 of the cooking well 12 and upwardly extending from the plane in which the cook top 11 lies. The upper raised edge 15 of the cook top 11 has a radially outwardly facing angled portion 16 extending at an obtuse angle from a plane in which of the cook top 11 lies. In use, the angled portion 16 of the upper raised edge 15 is designed for directing spills and fluids on the cook top 11 from spilling into the cooking well 12.

The insulating layer 17 is provided on the interior base wall 13 and the interior perimeter side wall 14 of the cooking well 12. The insulating layer 17 preferably substantially covers the interior base wall 13 and the interior perimeter side wall 14 of the cooking well 12. The insulating layer 17 ideally has a generally equal thickness along the interior base wall 13 and the interior perimeter side wall 14 of the cooking well 12. In use, the insulating layer 17 is designed for resisting the passage of heat therethrough so that heat stays in the cooking well.

Figure 6:
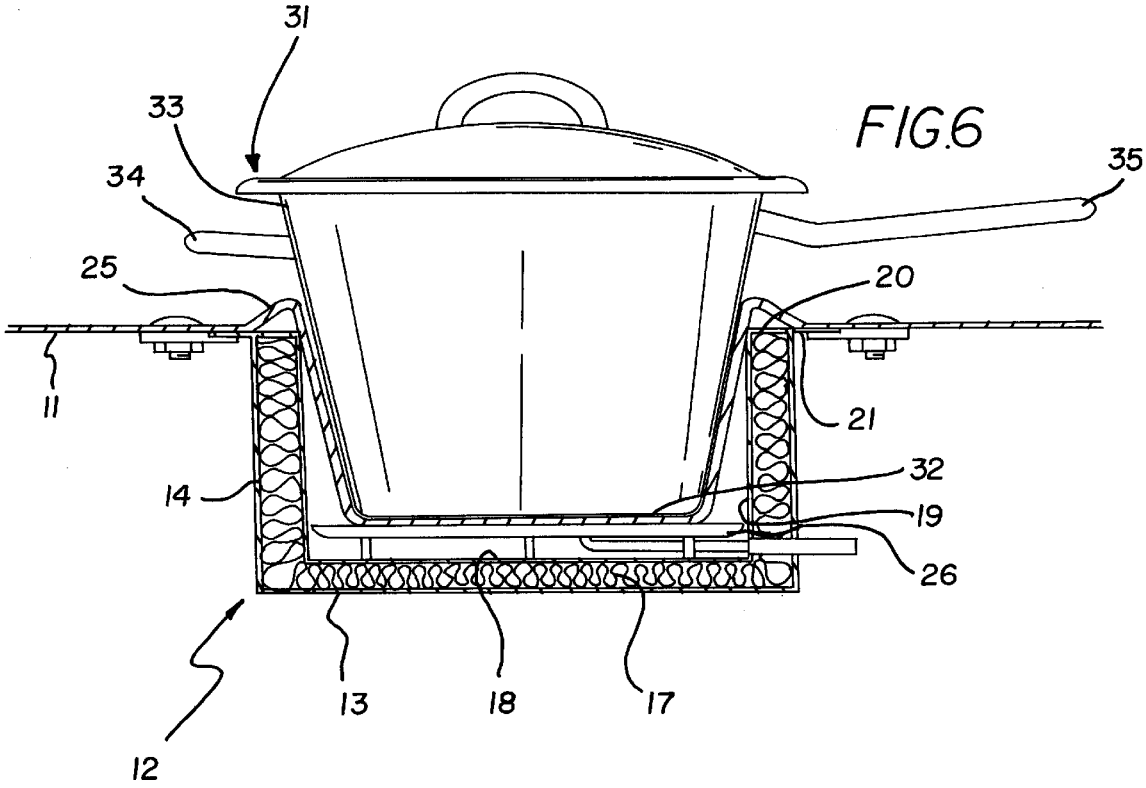
FIG. 6 is a schematic cross sectional view of a third embodiment of the cooking well of the present invention in use with an article of cookware designed for use in the cooking range system.

Preferably, as illustrated in FIG. 6, the cooking well 12 has a generally circular exterior base wall 18 and a generally cylindrical exterior perimeter side wall 19 upwardly extending around the exterior base wall 18 of the cooking well 12. The exterior base wall 18 and the exterior perimeter side wall 19 of the cooking well 12 substantially covers the insulating layer 17 such that the insulating layer 17 is interposed between the interior and exterior base walls 13,18 and perimeter side walls 14,19. In this embodiment, the cooking well 12 has an annular top flange 20 extending radially between a top edge of the exterior perimeter side wall 19 over the insulating layer 17 and a top edge of the interior perimeter side wall 14 to connect the top edges of the interior and exterior perimeter side walls 14,19 together and to substantially cover a top portion of the insulating layer 17. The top flange 20 has an outer portion 21 extending radially outwards from the interior perimeter side wall 14. The outer portion 21 is coupled to the cook top 11.

Figure 5:
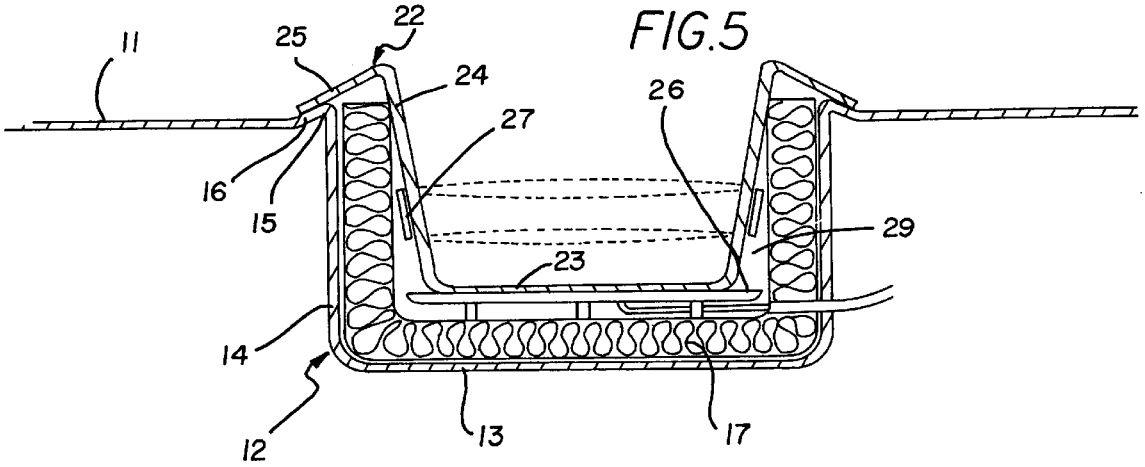
FIG. 5 is a schematic cross sectional view of another embodiment of a cooking well of the present invention.

The drop basin 22 provided in the cooking well 12. In use, the drop basin 22 is designed for receiving therein an article of cookware 31 such as a pot or pan. The drop basin 22 has a generally circular bottom wall 23 and a generally frusto-conical side wall 24 upwardly extending around the bottom wall 23 so that the diameter of the side wall 24 tapers towards the bottom wall 23 of the drop basin 22 with the side wall 24 extending at an obtuse angle to the bottom wall 23 of the drop basin 22. Preferably, the bottom wall 23 of the drop basin 22 and the interior and exterior base walls 13,18 of the cooking well 12 generally lie in generally parallel planes. The top of the side wall 24 of the drop basin 22 has an upper lip 25 extending radially outwards therefrom. The upper lip 25 of the drop basin 22 is upwardly extended from the plane of the cook top 11 preferably at an obtuse angle from the plane of the cook top 11. In use, the upper lip 25 of the drop basin 22 is designed for directing spills and fluids on the cook top 11 from spilling into the cooking well 12 and for preventing spills on the heating element so that cleanup of the cook top 11 is quick and easy. In one preferred embodiment as illustrated in FIG. 6, the upper lip 25 of the drop basin 22 is contiguous with the cook top 11. In another preferred embodiment as illustrated in FIGS. 4 and 5, the upper lip 25 of the drop basin 22 is rested on the cook top 11 on the angle portion of the upper raised edge 15 of the cook top 11.

The coiled heating element 26 is designed for providing cooking heat and is provided in the cooking well 12 beneath the bottom wall 23 of the drop basin 22. The heating element 26 and the bottom wall 23 of the drop basin 22 preferably generally lie in generally parallel planes with the heating element 26 abutting the bottom wall 23 of the drop basin 22 so that heat from the heating element 26 is directly transferred to the bottom wall 23 of the drop basin 22. Optionally as illustrated in FIG. 5, an annular secondary heating element 27 for providing cooking heat may be provided in the cooking well 12 around the side wall 24 of the drop basin 22. Like the coiled heating element 26, the secondary heating element 27 preferably abuts the side wall 24 of the drop basin 22 so that heat from the secondary heating element 27 is directly transferred to the side wall 24 of the drop basin 22. In use, the secondary heating element 27 is designed for enhancing the heat generated in the cooking well 12. The heating elements 26,27 are electrically connected to an electrical power source and the cooking range has appropriate controls 28 for turning on and off the heating elements and controlling the amount of heat provided by the heating elements.

In use, the drop basin 22 and the insulating layer 17 define a heating chamber 29 in the cooking well 12 so that heat from the heating elements 26,27 is concentrated in the heating chamber 29 so that heat is provided to the bottom 32 and sides of an article of cookware 31 in the cooking well 12.

Preferably, the cook top 11 has a lid 30 substantially covering the cooking well 12 when the cooking well 12 is not in use to prevent spills and food from falling into the cooking well 12 when not in use.

The system also preferably includes articles of cookware 31 each having a generally circular bottom 32 and a generally frusto-conical perimeter side 33 upwardly extending around the bottom 32 of the article of cookware 31. In use as illustrated in FIG. 6, each article of cookware 31 is inserted into the cooking well 12 such that the bottom 32 of the article of cookware 31 rests on the bottom wall 23 of the drop basin 22 and the perimeter side 33 of the article of cookware 31 abuts the side wall 24 of the drop basin 22. This helps maximize contact between the article of cookware 31 and the drop basin 22 to obtain an optimal and efficient amount of heat transfer between the drop basin 22 and the article of cookware 31. Preferably, the article of cookware 31 has a pair of diametrically positioned handles 34,35 on the perimeter side 33 of the article of cookware 31 for aiding lifting of the article of cookware 31 in and out of the cooking well 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A cooking range system, comprising:

a cooking range having a generally flat cook top, said cook top having a cooking well therein;

said cooking well having an interior base wall and an interior perimeter side wall upwardly extending around said interior base wall of said cooking well;

an insulating layer being provided on said interior base wall and said interior perimeter side wall of said cooking well, said insulating layer substantially covering said interior base wall and said interior perimeter side wall of said cooking well;

a drop basin provided in said cooking well;

an article of cookware having a bottom and a perimeter side upwardly extending around said bottom of said article of cookware;

said drop basin being for receiving therein said article of cookware, said drop basin having a bottom wall and a side wall upwardly extending around said bottom wall;

said article of cookware, said article of cookware being insertable into said cooking well such that said bottom of said article of cookware rests on said bottom wall of said drop basin and said perimeter side of said article of cookware abuts said side wall of said drop basin for maximizing contact between said article of cookware and said drop basin; and a coiled heating element being provided in said cooking well beneath said bottom wall of said drop basin, said heating element and said bottom wall of said drop basin generally lying in generally parallel planes, said heating element abutting said bottom wall of said drop basin such that heat from said heating element is directly transferred to said bottom wall of said drop basin.

2. The cooking range system of claim 1, wherein said cook top has an annular raised edge around said interior perimeter side wall of said cooking well and upwardly extending from said cook top, said upper raised edge of said cook top having a radially outwardly facing angled portion extending at an obtuse angle from a plane of said cook top.

3. The cooking range system of claim 1, wherein said insulating layer substantially covers said interior base wall and said interior perimeter side wall of said cooking well, said insulating layer having a generally equal thickness along said interior base wall and said interior perimeter side wall of said cooking well.

4. The cooking range system of claim 1, wherein said cooking well has an exterior base wall and an exterior perimeter side wall upwardly extending around said exterior base wall of said cooking well, said insulating layer being interposed between said interior and exterior base walls and perimeter side walls.

5. The cooking system of claim 4, wherein said cooking well has a top flange extending radially between a top edge of said exterior perimeter side wall and a top edge of said interior perimeter side wall to connect said top edges of said interior and exterior perimeter side walls together.

6. The cooking system of claim 5, wherein said top flange has an outer portion extending radially outwards from said interior perimeter side wall, said outer portion being coupled to said cook top.

7. The cooking system of claim 1, wherein said side wall of said drop basin has an upper lip extending radially outwards therefrom, said upper lip of said drop basin being upwardly extended from said cook top, said upper lip being extended at an obtuse angle from said cook top.

8. The cooking system of claim 7, wherein said upper lip of said drop basin is contiguous with said cook top.

9. The cooking system of claim 7, wherein said upper lip of said drop basin is rested on said cook top on said angle portion of said upper raised edge of said cook top.

10. The cooking system of claim 1, further comprising an annular secondary heating element for providing cooking heat being provided in said cooking well around said side wall of said drop basin.

11. The cooking system of claim 1, further comprising an article of cookware having a bottom and a perimeter side upwardly extending around said bottom of said article of cookware, said article of cookware being inserted into said cooking well such that said bottom of said article of cookware rests on said bottom wall of said drop basin and said perimeter side of said article of cookware abuts said side wall of said drop basin to maximize contact between said article of cookware and said drop basin.

12. A cooking range system, comprising:

a cooking range having a generally flat cook top, said cook top having at least one cooking well therein;

said cooking well being generally cylindrical and having a generally cylindrical interior base wall and an interior perimeter side wall upwardly extending around said interior base wall of said cooking well;

said cook top having an annular raised edge around said interior perimeter side wall of said cooking well and upwardly extending from said cook top;

said upper raised edge of said cook top having a radially outwardly facing angled portion extending at an obtuse angle from a plane in which said cook top lies said upper raised edge being adapted for directing spills and fluids on said cook top from spilling into said cooking well;

an insulating layer being provided on said interior base wall and said interior perimeter side wall of said cooking well, said insulating layer substantially covering said interior base wall and said interior perimeter side wall of said cooking well;

said insulating layer having a generally equal thickness along said interior base wall and said interior perimeter side wall of said cooking well, said insulating layer being adapted for resisting the passage of heat therethrough;

said cooking well having a generally circular exterior base wall and a generally cylindrical exterior perimeter side wall upwardly extending around said exterior base wall of said cooking well, said exterior base wall and said exterior perimeter side wall of said cooking well substantially covering said insulating layer such that said insulating layer is interposed between said interior and exterior base walls and perimeter side walls;

said cooking well having an annular top flange extending radially between a top edge of said exterior perimeter side wall over said insulating layer and a top edge of said interior perimeter side wall to connect said top edges of said interior and exterior perimeter side walls together and to substantially cover a top portion of the insulating layer;

said top flange having an outer portion extending radially outwards from said interior perimeter side wall, said outer portion being coupled to said cook top;

a drop basin provided in said cooking well, said drop basin being adapted for receiving therein an article of cookware, said drop basin having a generally circular bottom wall and a generally frusto-conical side wall upwardly extending around said bottom wall said side wall of said drop basin having a diameter tapering towards said bottom wall of said drop basin, said side wall of said drop basin being extended at an obtuse angle to said bottom wall of said drop basin;

said bottom wall of said drop basin and said interior and exterior base walls of said cooking well generally lying in generally parallel planes;

said side wall of said drop basin having an upper lip extending radially outwards therefrom, said upper lip of said drop basin being upwardly extended from the plane of said cook top, said upper lip being extended at an obtuse angle from the plane of said cook top, said upper lip of said drop basin being adapted for directing spills and fluids on said cook top from spilling into said cooking well and for preventing spills on the heating element;

wherein said upper lip of said drop basin is rested on said cook top on said angle portion of said upper raised edge of said cook top;

a coiled heating element for providing cooking heat being provided in said cooking well beneath said bottom wall of said drop basin, said heating element and said bottom wall of said drop basin generally lying in generally parallel planes, said heating element abutting said bottom wall of said drop basin such that heat from said heating element is directly transferred to said bottom wall of said drop basin;

an annular secondary heating element for providing cooking heat being provided in said cooking well around said side wall of said drop basin, said secondary heating element abutting said side wall of said drop basin such that heat from said secondary heating element is directly transferred to said side wall of said drop basin, said secondary heating element being adapted for enhancing the heat generated in the cooking well;

said heating elements being electrically connected to an electrical power source and said cooking range having controls for turning one and off the heating elements and controlling the amount of heat provided by the heating elements;

said drop basin and said insulating layer defining a heating chamber in said cooking well, wherein heat from the heating elements is concentrated in said heating chamber for providing heat to the bottom and sides of said article of cookware when said article of cookware is positioned in the cooking well;

said cook top having a lid substantially covering said cooking well when said cooking well is not in use to prevent spills and food from falling into the cooking well when not in use;

an article of cookware having a generally circular bottom and a generally frusto-conical perimeter side upwardly extending around said bottom of said article of cookware, said article of cookware being inserted into said cooking well such that said bottom of said article of cookware rests on said bottom wall of said drop basin and said perimeter side of said article of cookware abuts said side wall of said drop basin to maximize contact between said article of cookware and said drop basin for maximizing efficient heat transfer between the drop basin and the article of cookware; and wherein said article of cookware has a pair of diametrically positioned handles on said perimeter side of said article of cookware for aiding lifting of the article of cookware in and out of the cooking well, said handles being positioned in spaced relationship to said cook top when said article of cookware is positioned in said cooking well.

* * * * *